US005308296A

United States Patent [19]

Eckstein

[11] Patent Number: 5,308,296

[45] Date of Patent: May 3, 1994

[54] INTERACTIVE VIDEO AND EXERCISE APPARATUS

[76] Inventor: Donald Eckstein, 8125 SW. 205 Ter., Miami, Fla. 33189

[21] Appl. No.: 914,879

[22] Filed: Jul. 16, 1992

[51] Int. Cl.[5] ..... A63B 21/005

[52] U.S. Cl. ..... 482/5; 482/8; 482/111; 482/902; 434/307; 273/85 G; 273/438; 273/DIG. 28; 73/379.09

[58] Field of Search ..... 482/1, 4-8, 482/52-54, 57, 58, 71-73, 75, 111, 112, 901-903; 128/25 R, 25 B; 434/29, 45, 55, 58, 365, 59, 61, 318, 62, 247, 307, 308, 372, 373, 392; 273/85 G, 434-438, 440-442, 460, DIG. 28, 148 B; 73/379.01, 379.07, 379.09; 395/152; 364/410, 578; 472/30, 47; 369/30, 33

[56] References Cited

U.S. PATENT DOCUMENTS

| | | | |
|---|---|---|---|
| 4,066,256 | 1/1978 | Trumbull | 434/59 X |
| 4,278,095 | 7/1981 | Lapeyre | 482/7 X |
| 4,408,613 | 10/1983 | Relyea | 128/670 |
| 4,491,325 | 1/1985 | Bersheim | 273/DIG. 28 X |
| 4,630,817 | 12/1986 | Buckley | 482/1 X |
| 4,657,247 | 4/1987 | Okada | 273/DIG. 28 x |
| 4,711,447 | 12/1987 | Mansfield | 482/902 X |
| 4,735,410 | 4/1988 | Nobuta | 482/902 X |
| 4,976,435 | 12/1990 | Shatford et al. | 482/6 X |
| 5,076,584 | 12/1991 | Openiano | 482/902 X |
| 5,104,119 | 4/1992 | Lynch | 482/5 |
| 5,149,084 | 9/1992 | Dolebout et al. | 482/52 X |
| 5,213,555 | 5/1993 | Hood et al. | 482/902 X |

FOREIGN PATENT DOCUMENTS

| | | | |
|---|---|---|---|
| 2822343 | 11/1979 | Fed. Rep. of Germany | 482/902 |
| 3218086 | 12/1983 | Fed. Rep. of Germany | 482/902 |
| 3404539 | 8/1985 | Fed. Rep. of Germany | 482/902 |

*Primary Examiner*—Richard J. Apley
*Assistant Examiner*—Joe H. Cheng
*Attorney, Agent, or Firm*—Robert M. Downey

[57] ABSTRACT

An interactive video and exercise apparatus, to be used to perform physical conditioning exercises interactively with an action scenario displayed on a video monitor, the apparatus including a support frame having a number of exercise devices adjustably attached thereto so as to allow a complete range of exercise movements simulating various physical activities corresponding with the action scenario on the video monitor. A compact disc-interactive player, video monitor, and audio output are positioned on the support frame and are interconnected to one another and each of the exercise devices such that the resistance of movement of the exercise devices is varied in accordance with a corresponding scenario segment of a scenario program being played on the CD-I player, as data is continuously exchanged between the exercise devices and the compact disc-interactive player, enabling the scenario program to interactively proceed in accordance with the user's actions.

13 Claims, 3 Drawing Sheets

INTERACTIVE VIDEO AND EXERCISE APPARATUS

BACKGROUND OF THE INVENTION

1. Field of the Invention

This invention relates to an interactive video and exercise apparatus which enables a user to perform physical conditioning exercises in accordance with an enjoyable interactive action scenario, the action scenario's progression directly varying with relation to a user's actions, thereby providing a comprehensive, enjoyable, and completely interactive means of entertainment, physical conditioning, and competition with other users.

2. Description of the Related Art

Physical fitness is an important priority for many individuals. Unfortunately, individuals often become bored when performing strenuous exercise routines, thus decreasing their desire to work out. For this reason, individuals are often searching for ways to make their exercising more enjoyable, thereby helping to make the exercise period go by quickly. This is evidenced by the invention of exercise devices such as those disclosed in Yang, U.S. Pat. No. 4,709,917, Bicocchi, U.S. Pat. No. 4,512,566, and Nobutal U.S. Pat. No. 4,735,410 which include the use of exercise devices such as rowing machines or stationary bikes, in combination with a CRT display. Devices such as these, however, are limited to enabling the user to change direction around an obstacle, increase the rate of passage of the scenery in accordance with the velocity of exercising, or vary resistance in accordance with the strength of the user. Such devices, while simulating passing scenery, are not structured to be completely interactive so as to follow a selected action scenario in which a user must overcome obstacles and make decisions which will directly effect the remainder of the scenario and obstacles to be overcome, and which enable the performance of a variety of different exercises which simulate actions to be performed throughout the scenario. Further, the devices in the related art are not structured to produce a wide variety of scenario outcomes based on various scenario story lines and skill levels such that a user does not become bored after repeating the same exercises over and over again.

The present invention is structured precisely to act in this manner and incorporates modern CD-I player technology to enable real time interaction, easy input of new scenarios, and a variety of scenario outcomes directly related to choices and physical reactions made by a user.

Additionally, the present invention may be specifically adapted to an individual user such that users of different physical characteristics can participate in the same scenario on an equal advantage level. This feature, along with the CD-I's ability to maintain score depending upon an individual's successful progression through a particular scenario, also makes the invention usable for entertainment, action, and sport-type scenarios. In fact, the invention, as a result of its ability to adjust to an individual's physical attributes, is one of the few physical exercise devices wherein individuals of different sexes and physical characteristics may compete directly with one another and have fair results. The present invention uniquely combines a number of variable resistance exercise devices to enable a real life action situation to be simulated, thereby enabling an individual utilizing the apparatus to combine physical and mental activity in a manner which makes demanding physical exercise mentally stimulating and not boring.

SUMMARY OF THE INVENTION

The present invention is directed towards an interactive video and exercise apparatus. The apparatus includes a support frame with a plurality of exercise devices adjustably attached thereto, a CD-I player, video monitor, and audio monitor positioned on the support frame, and interface means to enable real time interaction between the exercise devices and a scenario program being played on the CD-I player. More particularly, a scenario program relating to an action adventure or the like is stored on a compact disc for playing within the CD-I player, the scenario program including a number of scenario segments which play out a series of events. In addition to providing a display on the video monitor, the scenario program, in accordance with a particular scenario segment being displayed controls the difficulty of particular exercises being performed by sending inputs to variable dampening means included with each of the exercise devices. As a result, a particular action being performed such as walking, climbing stairs, or mountains, and the like, can be accurately simulated. Additionally, input regarding the actions performed by a user and specific selections made such as to go up or down stairs, to go left or right, or to climb over an obstacle or continue to look for another way around, are transmitted to the CD-I player such that the difficulty of the action to be performed may be accurately simulated, and such that the next scenario segment, which is selected directly in accordance with the previous actions taken, may be selected.

It is an object of this invention is to provide a completely interactive exercise apparatus which will make exercising enjoyable and therefore more productive.

Another object of the present invention is to provide an interactive exercise apparatus which enables an individual to actively participate in a variety of variable outcome action scenarios.

Yet another object of the present invention is to provide an interactive exercise apparatus which enables a variety of exercises to be performed in response to various physical challenges presented to a user on a video display so as to effectively work on a number of different muscle groups throughout the body.

Still another object of the present invention is to provide an interactive exercise apparatus including an interactive action adventure video scenario which is directly responsive to physical action taken by a user.

A further object of the present invention is to incorporate compact disc-interactive technology to be effectively utilized as a component part of the interactive exercise apparatus, as well as independently of the exercise portion of the apparatus.

An additional object of the present invention is to enable users of different physical characteristics to participate at an equal advantage level on a user selected skill level that corresponds with each user's physical and mental limitations.

Another object of the present invention is to allow individuals with physical motor skill limitations, like paralysis below the waist, and sensory limitations, like deafness, to enjoy the same type of scenario programming as able bodied individuals, and to compete on an equal advantage level.

A further object of the present invention is to allow the simulation of mentally and physically demanding tasks performed by professionals, such as police, fire fighters and the like, in a way that accurately duplicates the stresses and physical demands of these tasks often encountered in real life, without the risk of physical injury that is often present.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
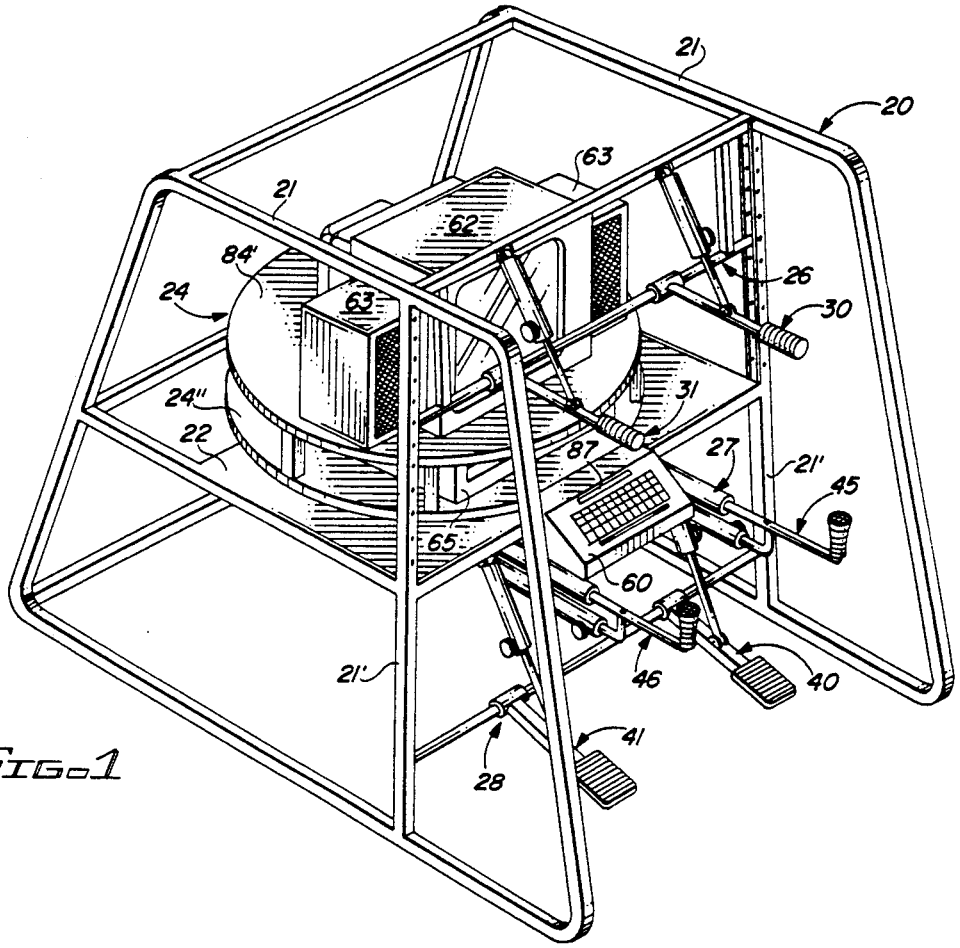
FIG. 1 is a perspective view of the interactive video and exercise apparatus of the present invention.
Figure 2:
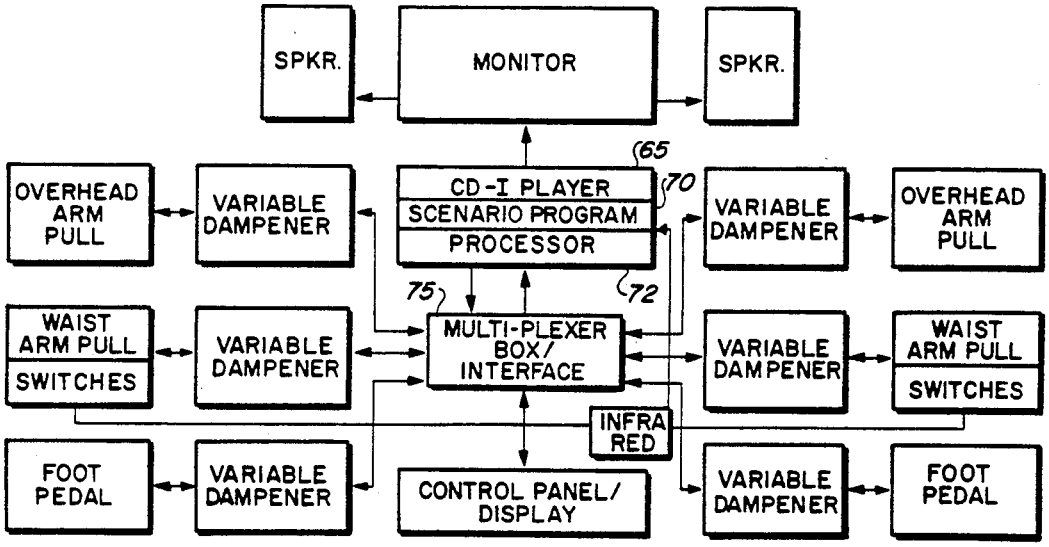
FIG. 2 is a block diagram detailing the interaction of the various components of the interactive video and exercise apparatus.

As detailed throughout FIGS. 1-6, the present invention is directed towards an interactive video and exercise apparatus, generally indicated as 10. The apparatus 10, as best seen in FIG. 1, includes a support frame structure 20 whereon various component elements are positioned and connected. More particularly, the support frame structure 20 includes a pair of rigid, sturdy, trapezoidal frame units 21 having a central platform 22 disposed therebetween and secured between a pair of support bars 21' and said frame units 21. Positioned atop the central platform 22 is a two-tiered turntable 24. The turntable 24 which includes an upper level 24' and a lower level 24' positioned in spaced apart relation therefrom is rotatable upon the central platform 22 to at least a 90 degree arc.

Supportably mounted to the support frame structure 20 are a plurality of exercise members 26, 27 and 28. These exercise members, which include a stairstepper assembly 28, an overhead arm puller assembly 26, and a waist level arm puller assembly 27 are adjustably mounted between the support bars 21' so as to be oriented for combined use and such that their orientation may be varied for the comfort of a particular user. More particularly, an individual standing on the stairstepper assembly 28 should be able to comfortably reach the overhead arm pullers 26 and have the waist level arm pullers properly disposed at their waist level.

Figure 3:
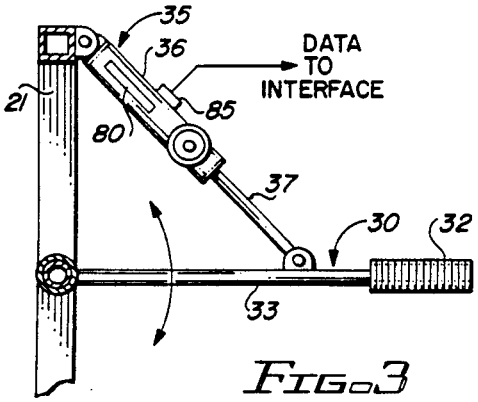
FIG. 3 is a detailed side view of an overhead arm puller included as part of the apparatus of the present invention.

Referring to FIGS. 1 and 3, the overhead arm puller assembly 26 includes a right and left assembly 30 and 31, respectively. As shown in FIG. 3, each of the arm pullers 30 and 31 includes a gripper handle 32 at a distal end of a pivot arm 33. The pivot arm 33 which may be pushed up or pulled downward is hingedly connected at a central portion thereof with variable dampening means 35. When utilized with the overhead arm puller assembly 26, the variable dampening means 35, in the form of a shock absorber type apparatus, includes an exterior compression arm 36 and an interior compression arm 37, the resistance level of movement being electronically alterable so as to effectively vary the difficulty of movement.

Figure 4:
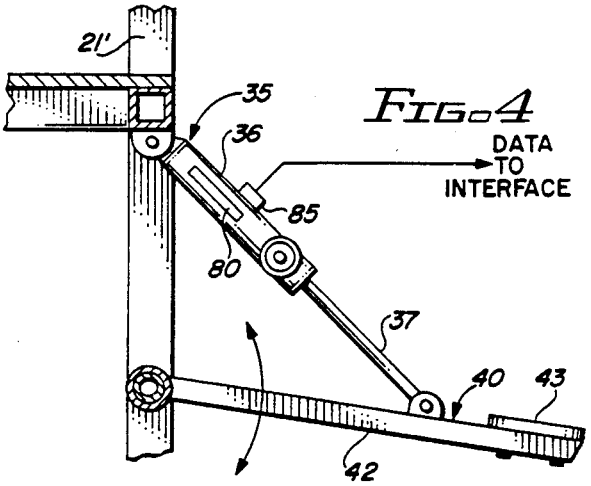
FIG. 4 is a detailed side view of a stairstepper included as part of the apparatus of the present invention.
Figure 10:
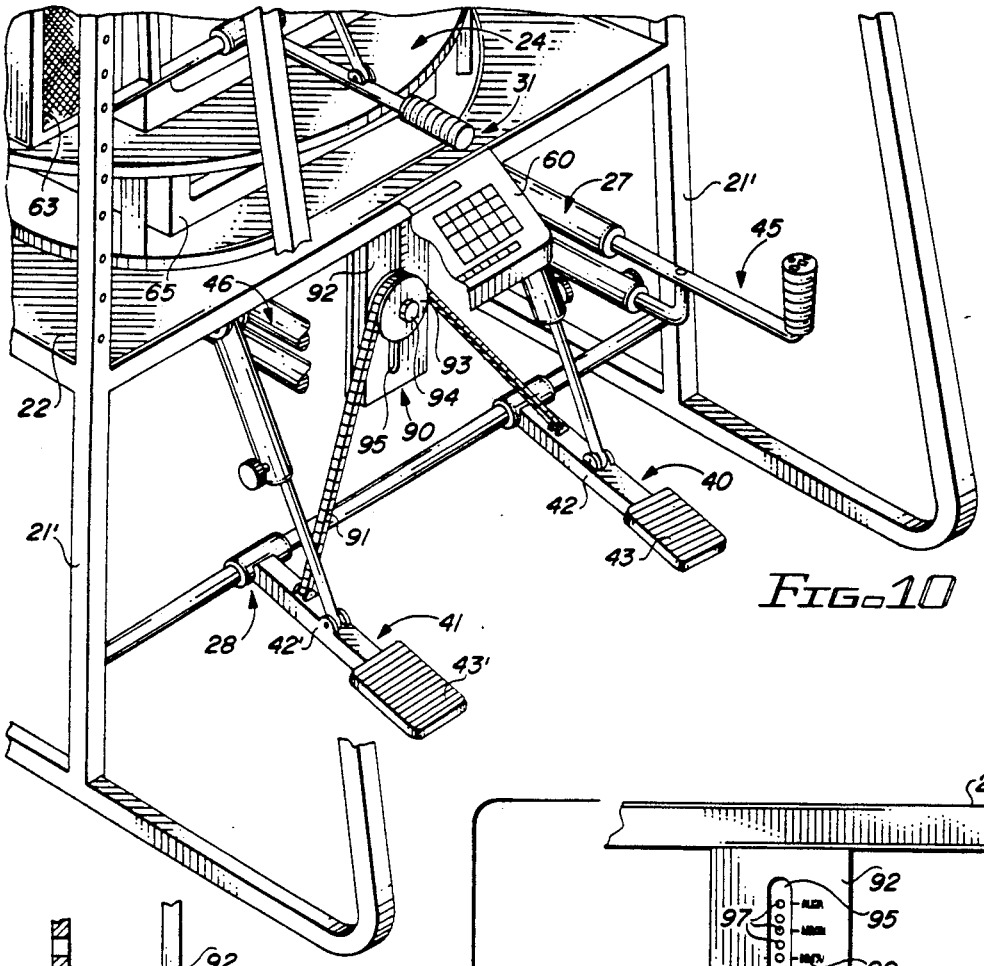
FIG. 10 is a perspective view of the exercise apparatus illustrating the interconnection of the stairstepper assembly to the frame structure.
Figure 9:
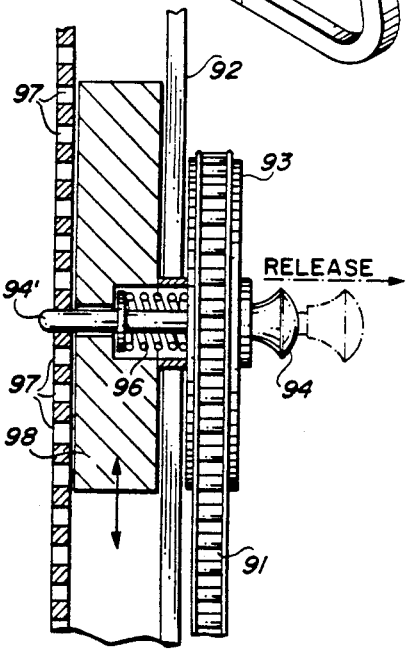
FIG. 9 is a cross-sectional view of the synchronizing means taken along line 9—9 of FIG. 8.
Figure 8:
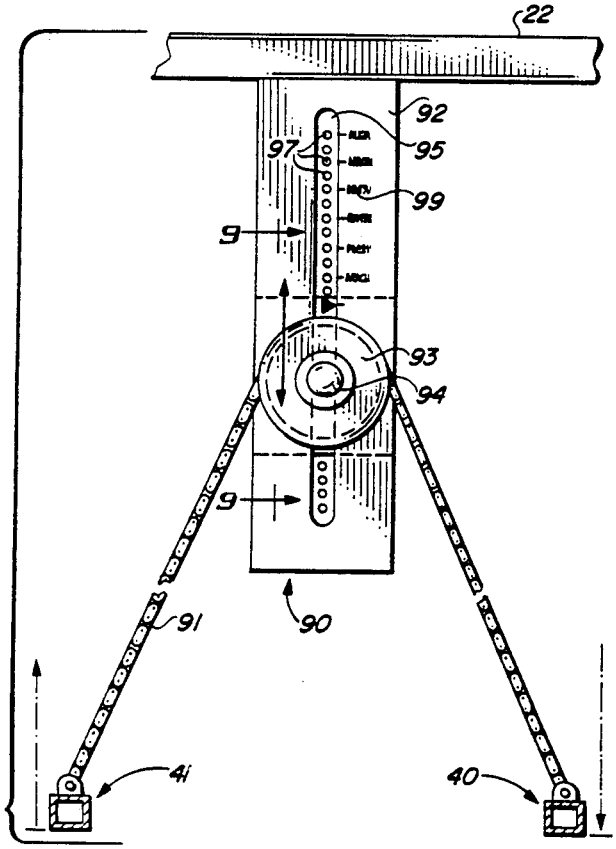
FIG. 8 is a front view of the synchronizing means which interconnect the stairsteppers of the present invention.

Turning to FIGS. 1, 4 and 10, the stairstepper assembly 28 includes a right step 40 and left step 41. As shown in FIGS. 4 and 10, each of the steps 40 and 41 includes an elongate lever 42 and 42' and a step portion of 43 and 43' upon which an individual may position their feet. The levers 42 and 42' are pivotally mounted to the frame structure 20, and are hingedly mounted at a central portion thereof to variable dampening means 35, which are much like the shock absorber type variable dampening means 35 employed with the overhead arm pullers 30 and 31. As a result, the resistance of the stepping movement can be varied to effectively simulate stair climbing or walking and running on different terrains. In order to assure that the steps 40 and 41 can properly simulate climbing or walking, both steps are interconnected with one another by synchronizing means 90, best seen in 8, 9, and 10. These synchronizing means 90 include primarily, a synchronizing chain 91 which is attached at opposite distal ends thereof with the levers 42 and 42'. This chain 91 is movably engaged about a sprocket 93 such that when one of the steps 40 or 41 is pushed downward, the other step 40 or 41 will be pulled upward simultaneously, thereby assuring that when one of the steps 40 or 41 is in an uppermost position the other step 40 or 41 is in a lowermost position. So as to allow secure, yet adjustable positioning of the sprocket 93, the sprocket 93 is mounted within an adjustment track 92. The adjustment track 92 is attached to the frame structure 20 below the central platform 22, and is centrally disposed between the steps 40 and 41 in a generally elevated position. As detailed in FIGS. 9 and 10, the sprocket 93 is adjustably positioned within the track 92 by means of a locking pin 94, which radially extends through the sprocket 93. The lock pin 94 is structured such that a distal lock tip 94' thereof can be lockingly engaged within one of a plurality of adjustment apertures 97 in the track 92. In order to maintain the lock pin 94 engaged within one of the apertures 97, the lock pin 94 is secured to a spring 96 which exerts a biasing force on the lock pin 94. The lock pin 94 may be removed from one of the apertures 97 by pulling outwardly, and while disengaged, the lock pin 94 and sprocket 93 may be slid along a channel 95 in the track 92 for positioning within a desired aperture 97. Additionally, a securing block 98 is contained within the track 92 to assure smooth movement of the lock pin 94 along the channel 95. Each of the apertures 97 is disposed to correspond an ideal stroke length for a user of a particular height. More particularly, by moving the sprocket 93 up along the track 92, the stroke length will increase. To assist in ascertaining a proper stroke length, indicia 99 are printed along the channel 95 so as to correlate to a particular adjusted position based on the ideal stroke length for the particular height of the individual user. Individual users could, however, tailor the stroke length to their particular needs.

Figure 5:
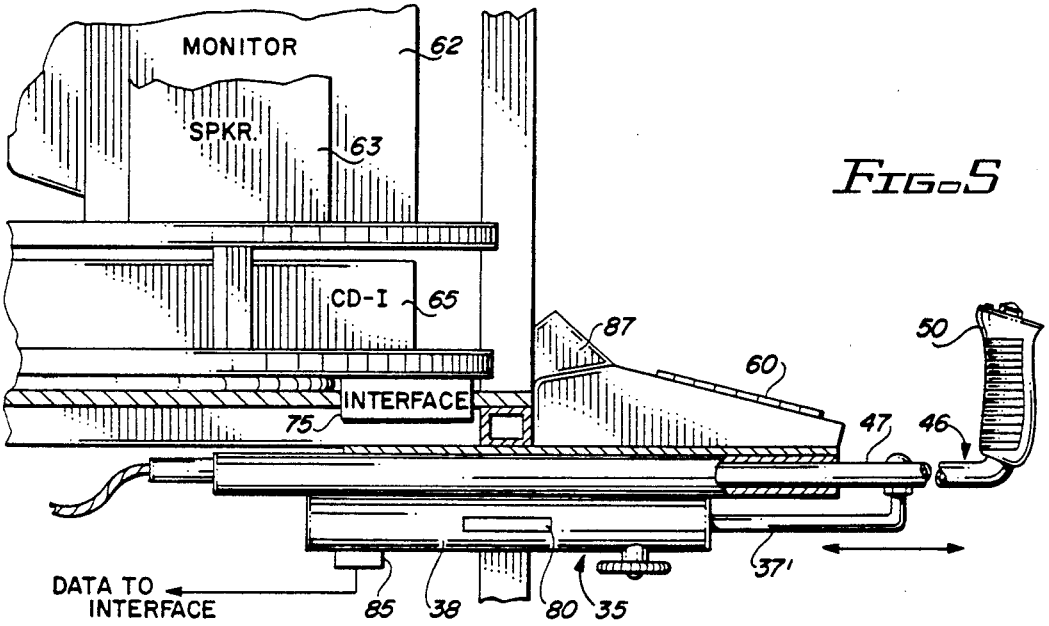
FIG. 5 is a detailed side view of the waist level arm puller of the apparatus of the present invention.
Figure 6:
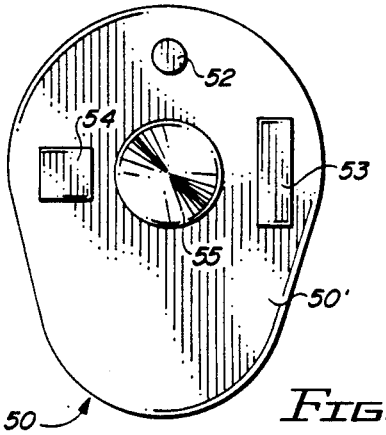
FIG. 6 is a detailed top view of the control grip on a waist level arm puller of the apparatus of the present invention.

As best seen in FIGS. 1 and 5, the waist level arm pullers assembly 27 includes a right arm puller 45 and 46. Each of the waist level arm pullers 45 and 46 includes an elongate shaft 47 which is fixedly attached to the variable dampening means 35. Variable dampening means are also provided on the waist level arm pullers 45 and 46, and include an exterior compressing chamber 36 and an L-shaped compression arm 37' which moves parallel to the pull shaft 47. Positioned at a distal end of the pull shaft 47 is a control grip 50 structured so as to enable facilitated grasp and control of the waist level arm pullers 45 and 46.

Figure 7:
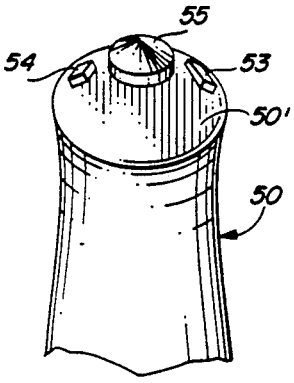
FIG. 7 is a perspective view of the control grip on a waist level arm puller of the apparatus of the present invention.

As best seen in FIGS. 1 and 5, the exercise apparatus 10 includes a control panel and display 60 which enables manual control and operation of the variable dampening means 35 when an individual wishes to exercise non-interactively, yet wishes a record of activities and a varying range of exercise. Essentially disposed on the upper level 24' of the turntable 24 is a video monitor 62. Additionally, positioned on either side of the video monitor 62 are audio transmittal means 63 in the form of speakers. This video monitor 62 and audio transmittal means 63 are structured for receipt of related audio and video signals transmitted from a compact disc interactive player 65 mounted on the lower level 24' of the turntable 24. The CD-I player 65, and audio means 63 and video monitor 62 are mounted on the turn-table 24 such that they may easily be oriented for use independent of the exercise members 26, 27 and 28. The CD-I player 65 is structured to play a compact disc having a scenario program 70 stored thereon. The scenario program 70 includes a plurality of scenario segments, each of the segments dictating required movements of the exercise members 26, 27 and 28 to perform simulated actions requiring a range of movements and mental decisions. More particularly, as the scenario program 70 plays on the CD-I player 65, information regarding actions to be performed are interpreted by a processor 72 of CD-I player 65 and transmitted by interface means 75 to each of the variable dampening means 35. Accordingly, the difficulty of a particular simulated action to be performed will be directly related to the difficulty of that action if truly performed in accordance with the scenario segments. An example of this may include a situation where a user is required to climb a wall in which case the overhead arm pullers 26 and stairstepper 28 would be utilized to simulate a climbing motion, the steepness and difficulty of the climb being reflected by the resistance resulting from the variable dampening means 35. Additionally, data is transmitted from each of the exercise members 26, 27 and 28 to the interface 75, the interface 75 including a multiplexing box such that multiple input and output may properly pass through a single data port of the CD-I player 65, and to the processor 72 of the CD-I player 65 wherein the simulated actions performed may be interpreted by the processor 72 for subsequent control of the next scenario segment and according difficulty and range of possible future actions. More particularly, the waist level arm pullers 45 and 46 and overhead arm pullers 30 and 31 may additionally function as directional guides, such that an individual is not limited to a single set of simulated actions f or each scenario segment engaged. For example, an individual encountered with an obstacle of climbing a wall may choose to turn left or right and continue walking to find another way around, this would be performed by utilizing the waist level arm pullers 45 and 46 or overhead arm pullers 30 and 31 as programmed on scenario program 70 to indicate a left turn, and stepping on the stairsteppers 40 and 41. As a result, the following scenario segment and possible actions will be directly varied in accordance with the mental decision made. In order to provide data from the individual exercise member 26, 27 and 28, to the processor 72, a linear variable potential meter 80, is attached to the electronically variable dampening means 35, as seen in FIGS. 3, 4 and 5. As a result, the potential meter 80 collects data with regard to the speed and timing of a particular exercise action performed, as well as the occurrence of the action itself, thereby providing the processor with necessary data to properly proceed throughout the scenario program 70. In order to enable rapid real time adjustment of the scenario program 70 in accordance with the exercise actions performed, the preferred embodiment of the present invention utilizes data channel 85 which connects potential meter 80 to interface 75 so as to quickly transmit data to processor 72 of CD-I player 65. CD-I player 65 also receives system and scenario program inputs from the user via an infra red transmitter 87. Control grip 50 on waist level arm pullers 45 and 46 include a plurality of switches 52, 54, 54 and 55, best seen in FIGS. 6 and 7, on the upper face 50' of each control grip 50. These switches are utilized throughout scenario program 70 when controlling an on screen cursor, making particular selections, accessing a program menu, or pausing the scenario program 70. The switches located in control grip 50 and infra red transmitter 87 duplicate the function of the standard handheld remote infra transmitter of CD-I player 65. By utilizing standard existing infra red control channels, adaptation of CD-I player 65 is not necessitated. Also, the waist level arm pullers 45 and 46 may be used to steer vehicles entered during a scenario program 70 and the buttons 52, 53, 54 and 55 may be utilized to perform various functions therein.

The present invention is particularly structured for rapid interactive simulation of an action scenario. Through the use of the variable dampening means 35, the simulated actions can be quickly and easily varied to most ideally simulate the resistance level an individual would normally encounter when performing these activities, thereby providing a fully comprehensive workout. Simulated activities contained on the scenario program 70 could also closely duplicate specific tasks performed by professionals such as police officers, fire fighters, and the like, and be used as a proficiency training system, without involving the potential risks of physical injury encountered during real life simulations. Further, an individual may input characteristics with regard to their height, weight, gender, age, and other physical characteristics such that the resistance levels may be varied as appropriate. Also, an individual could input a physical handicap condition, like paralysis below the waist, which would result in the waist level arm pullers 45 and 46 to be used to provide the movement normally provided by the stair steppers 40 and 41, or sensory handicap type condition, such impaired hearing or vision, which would result in either video or audio compensation, in the form of text/action display of noises encountered or an audio narrative of location details, to help guide the user. Scenario program 70 contains scenario segments that have resistance levels set for a specific standard person. When the user inputs their specific physical characteristics into CD-I player 65, processor 72 increases or decreases resistance levels as appropriate to compensate for these variations. In such a manner, individuals of different physical characteristics may start scenario program 70 on an equal physical advantage level, a benefit not present in most forms of exercise or sports competition. When a user selects a higher skill level in scenario program 70, these resistance levels are increased, the time allotted to complete a specific scenario segment is decreased, and more demanding mental challenges are presented. In order to facilitate comparison, the CD-I player 65 processor 72 scores an individual's performance throughout a scenario program 70 based on decisions made, elapsed time in performing certain actions and other relevant data. Further, the amount of work performed, force exerted and other measures of physical exertion are also displayed for a user such that they may gage their accomplishments during a workout.

The present invention as described is a preferred embodiment at the time of invention, the variations including the particular exercise members employed are consistent with the intent of the inventor. Further, the scenario program 70 which is stored on a compact disc may include many types of action/adventure situations, sporting situations, or any other situation necessitating an individual to be active during participation.

What is claimed is:

1. An exercise apparatus comprising:

a support frame structure, a plurality of exercise members attached to said frame structure and movable relative thereto through a predetermined range of movement for performing one of a plurality of simulated actions by a user, a compact disc-interactive player supported on said frame structure and structured to play a compact disc having a scenario program recorded thereon, including a plurality of scenario segments, each of said scenario segments dictating required movements of said exercise members to perform said simulated actions, a video monitor supported on said frame structure and interconnected to and structured to receive a video signal from said compact disc-interactive player for displaying a real time motion video portion of said scenario program, audio means interconnected to and structured to receive an audio signal from said compact disc-interactive player for transmission of an audible sound portion of said scenario program corresponding with said motion video portion, variable dampening means interconnected to each of said exercise members and structured and disposed to variably control a level of resistance to movement of said exercise members so as to effectively vary the level of difficulty of moving said exercise members when performing said simulated actions as dictated by the scenario segment being presented at that time to the user, said variable dampening means including an electronic variable resistance dampening device interconnected to each of said exercise members, each of said variable resistance dampening devices including a linear variable potential meter attached thereto, said potential meter generating data relating to the movement of each of said exercise members for transmission to processing means and indicating said processing means when a movement of a particular one of said exercise members has been made including the rate and extent of that movement, interface means interconnected between said variable dampening means and said compact disc-interactive player and structured to transmit and receive data therebetween, said interface means including a multiplexing box structured and disposed to receive a plurality of data inputs from said potential meters for transmission through a combined input and output port of said compact disc-interactive player, said compact disc-interactive player including said processing means structured and disposed to receive and process data relating to the scenario segment being presented and the movement of the exercise members, said processing means further being structured and disposed to control said scenario program and transmit processed data to said interface means for controlling said variable dampening means so as to effectively vary the respective resistance levels of said exercise members, remote infra red transmitting and receiving means structured and disposed for transmitting and receiving said data between said interface means and said processing means, and whereby a new scenario segment is presented to the user as a direct result of the user's performance in moving said exercise members to execute said simulated actions in response to the previous scenario segment.

2. An apparatus as recited in claim 1 wherein said exercise members include a stairstepper assembly, said stairstepper assembly including a right lever and step portion, a left lever and step portion, and synchronizing means structured and to disposed cause the upward movement of one of said levers upon the downward movement of the other of said levers such that when one of said levers is in an uppermost position the other of said levers is in a lowermost position.

3. An apparatus as recited in claim 2 wherein said exercise members further include a right and a left overhead arm puller assembly.

4. An apparatus as recited in claim 3 wherein said exercise members further include a right and a left waist level arm puller assembly.

5. An apparatus as recited in claim 4 wherein each of said waist level arm pullers includes a control grip structured and disposed to facilitate movement of said waist level arm pullers, and accordingly to facilitate performance of one of said simulated actions.

6. An apparatus as recited in claim 5 wherein said control grips include a plurality of control switches thereon, said control switches adapted to transmit control data through said interface means to said processing means for receipt and processing thereof.

7. An as recited in claim 6 wherein said frame structure includes a control panel and display attached thereto and having a digital display and keys thereon and being structured and disposed f or manual control and operation of said variable dampening means independently of s .d processor means.

8. An apparatus as recited in claim 7 wherein said frame structure includes a centrally positioned turntable rotatably mounted thereto and structured and disposed to support said compact disc-interactive player, video monitor, and audio means thereon so as to be rotatably movable relative to the user and said frame structure, thereby allowing said compact discinteractive player, video monitor, and audio means to be conveniently disposed for use independent of said exercise members.

9. An apparatus as recited in claim 8 wherein said processing means is structured and disposed to calculate and display on said video monitor, a user's score, amount of work performed, and force exerted.

10. An apparatus as in claim 9 wherein said synchronizing means includes a synchronizing chain attached at opposite distal ends thereof to said right lever and said left lever of said stairstepper assembly, and a centrally disposed sprocket mounted to said frame structure substantially above said right lever and said left lever, said chain being movably engaged about said sprocket so as to interconnect said levers and pull one of said levers upward when the other of said levers is pushed downward.

11. An apparatus as in claim 10 wherein said sprocket is adjustably disposed on an adjustment track, said adjustment track extending downwardly from said frame structure and including locking means structured and disposed to adjustably lock said sprocket in one of a plurality of adjusted positions along said track.

12. An apparatus as in claim 10 wherein said adjustment track includes indicia thereon,, said indicia correlating the stroke length of said stairstepper assembly at a particular one of said adjusted positions on said adjustment track with an ideal user height for that stroke length.

13. An exercise apparatus comprising:

a support frame structure, a plurality of exercise members attached to said frame structure and movable relative thereto through a predetermined range of movement for performing one of a plurality of simulated actions by a user, said exercise members including a stairstepper assembly, said stairstepper assembly including a right lever and step portion, a left lever and step portion, and synchronizing means structured and disposed to cause the upward movement of one of said levers upon the downward movement of the other of said levers such that when one of said levers is in an uppermost position the other of said levers is in a lowermost position, said exercise members further including a right and a left overhead arm puller assembly and a right and a left waist level arm puller assembly, a compact disc-interactive player supported on said frame structure and structured to play a compact disc having a scenario program recorded thereon, including a plurality of scenario segments, each of said scenario segments dictating required movements of said exercise members to perform said simulated actions, a video monitor supported on said frame structure and interconnected to and structured to receive a video signal from said compact disc-interactive player for displaying a real time motion video portion of said scenario program, audio means interconnected to and structured to receive an audio signal from said compact disc-interactive player for transmission of an audible sound portion of said scenario program corresponding with said motion video portion, variable dampening means interconnected to each of said exercise members and structured and disposed to variably control a level of resistance to movement of said exercise members so as to effectively vary the level of difficulty of moving said exercise members when performing said simulated actions as dictated by the scenario segment being presented at that time to the user, said dampening means including an electronic variable resistance dampening device interconnected to each of said exercise members, each of said variable resistance dampening devices including a linear variable potential meter attached thereto, said potential meter generating data relating to the movement of each of said exercise members for transmission to processing means to indicate to said processing means when a movement of a particular exercise member has been made including the rate and extent of that movement, interface means interconnected between said variable dampening means and said compact disc-interactive player and structured to transmit and receive data therebetween, said interface means including a multiplexing box structured and disposed to receive a plurality of data inputs from said potential meters for transmission through a combined input and output port of said compact disc-interactive player, said compact disc-interactive player including said processing means structured and disposed to receive and process data relating to the scenario segment being presented and the movement of the exercise members, said processing means further being structured and disposed to control said scenario program and transmit processed data to said interface means for controlling said variable dampening means so as to effectively vary the respective resistance levels of said exercise members, remote infra red transmitting and receiving means structured and disposed for transmitting and receiving said data between said interface means and said processing means, each of said waste level arm pullers including a control grip structured and disposed to facilitate movement of said waste level arm pullers, and accordingly to facilitate performance of one of said simulated actions, said control grips including a plurality of control switches thereon adapted to transmit control data through said interface means to said processing means for receipt and processing thereof, said support frame structure including a control panel and display attached thereto and having a digital display and keys thereon being structured and disposed for manual control and operation of said variable dampening means independently of said processor means, a turntable centrally positioned and rotatably mounted to said frame structure and structured and disposed to support said compact disc-interactive player, video monitor, and audio means thereon so as to be rotatably movable relative to the user and said frame structure allowing said compact disc-interactive player, video monitor, and audio means to be conveniently disposed for use independent of said exercise members, and whereby a new scenario segment is presented to the user as a direct result of the user's performance in moving said exercise members to execute said simulated actions in response to the previous scenario segment.

* * * * *